US012723843B2

(12) United States Patent
Sakai et al.

(10) Patent No.: US 12,723,843 B2
(45) Date of Patent: Sep. 1, 2026

(54) OPTICAL SIGHT AND INFORMATION DISPLAY METHOD

(71) Applicant: LIGHT OPTICAL WORKS, LTD., Nagano (JP)

(72) Inventors: Kensuke Sakai, Nagano (JP); Kan Hanaoka, Nagano (JP); Takashi Abe, Nagano (JP); Wataru Kawai, Nagano (JP); Kenichi Seki, Nagano (JP)

(73) Assignee: LIGHT OPTICAL WORKS, LTD., Nagano (JP)

( * ) Notice: Subject to any disclaimer, the term of this patent is extended or adjusted under 35 U.S.C. 154(b) by 0 days.

(21) Appl. No.: 19/095,017

(22) Filed: Mar. 30, 2025

(65) Prior Publication Data

US 2026/0118091 A1 Apr. 30, 2026

(30) Foreign Application Priority Data

Oct. 24, 2024 (JP) ..... 2024-187263

(51) Int. Cl.
*F41G 3/08* (2006.01)
*F41G 1/38* (2006.01)

(52) U.S. Cl.
CPC ..... *F41G 3/08* (2013.01); *F41G 1/38* (2013.01)

(58) Field of Classification Search
CPC ..... F41G 3/065; F41G 3/08; F41G 1/3935; F41G 1/38
USPC ..... 42/122, 123, 119
See application file for complete search history.

(56) References Cited

U.S. PATENT DOCUMENTS 6,813,025 B2 * 11/2004 Edwards ..... F41G 1/38 359/399
2007/0209268 A1 * 9/2007 Birurakis ..... F41G 1/35 42/142
2015/0021394 A1 * 1/2015 Mencotti ..... F41G 11/00 235/404
2015/0247702 A1 * 9/2015 Davidson ..... F41G 1/473 42/122
2019/0186871 A1 * 6/2019 York ..... F41G 1/38

FOREIGN PATENT DOCUMENTS

JP 2022109448 7/2022

OTHER PUBLICATIONS

"Search Report of Europe Counterpart Application", issued on Sep. 24, 2025, pp. 1-9.

* cited by examiner

*Primary Examiner* — John Cooper
(74) *Attorney, Agent, or Firm* — JCIPRNET

(57) ABSTRACT

An optical sight is attached to a gun for use, including: an optical system, allowing a user to visually recognize a target serving as a sight target; a housing, accommodating the optical system; and an information display part, displaying information toward the user. The information display part is installed within the housing together with the optical system, so as to display the information around a field of view that the optical system allows the user to perform visual recognition.

7 Claims, 3 Drawing Sheets

OPTICAL SIGHT AND INFORMATION DISPLAY METHOD

CROSS-REFERENCE TO RELATED APPLICATION

This application claims the priority benefit of Japan application serial no. 2024-187263, filed on Oct. 24, 2024. The entirety of the above-mentioned patent application is hereby incorporated by reference herein and made a part of this specification.

BACKGROUND

Technical Field

The disclosure relates to an optical sight and an information display method.

Related Art

Conventionally, optical sights equipped on hunting rifles or sport pistols or the like have been widely used (for example, see Japanese Patent Laid-Open No. 2022-109448). As an optical sight, for example, a configuration including an adjustment mechanism that adjusts an impact position or the like has been widely used.

In the case of adjusting the impact position or the like for the optical sight, the adjustment mechanism is operated based on, for example, information such as a distance to a target serving as a sight target. In an optical sight having a conventional configuration, in order to confirm the information such as distance, it is sometimes necessary to take eyes off a field of view of the optical sight. However, in this case, for example, there is a risk that the stability of posture may decrease due to a change in posture occurring during adjustment of the impact position or the like. In the cases such as where the target moves, there is also a risk of losing sight of the target while taking eyes off the field of view of the optical sight. Accordingly, the disclosure aims to provide an optical sight and an information display method that can solve the above problems.

SUMMARY

According to one embodiment, an optical sight is provided that is attached to a gun for use. The optical sight includes: an optical system, allowing a user to visually recognize a target serving as a sight target; a housing, accommodating the optical system; and an information display part, displaying information toward the user. The information display part is installed within the housing together with the optical system, so as to display the information around a field of view that the optical system allows the user to perform visual recognition.

According to another embodiment, an information display method is provided that displays information in an optical sight attached to a gun for use. The information display method including: installing an information display part that displays the information toward a user inside a housing that accommodates an optical system that allows the user to visually recognize a target serving as a sight target in the optical sight; and, by the information display part, causing the information to be displayed around a field of view that the optical system allows the user to perform visual recognition.

BRIEF DESCRIPTION OF THE DRAWINGS

FIG. 1A is a cross-sectional view showing an example of a configuration of main parts of the optical sight 10. FIG. 1B is a block diagram schematically showing functions of some components in the optical sight 10. FIG. 1C shows an example of how information is displayed by an information display part 22.

FIG. 2A is a cross-sectional perspective view showing an example of how the information display part 22 is installed with respect to a viewing ring 108. FIG. 2B shows an example of a configuration of the viewing ring 108. FIG. 2C is an enlarged cross-sectional view showing a peripheral part of the viewing ring 108 in the optical sight 10.

FIG. 3A is a perspective view showing the viewing ring 108 and the information display part 22 shown in FIG. 2A. FIG. 3B shows another example of how the information display part 22 is attached.

DESCRIPTION OF THE EMBODIMENTS

Figure 1A:
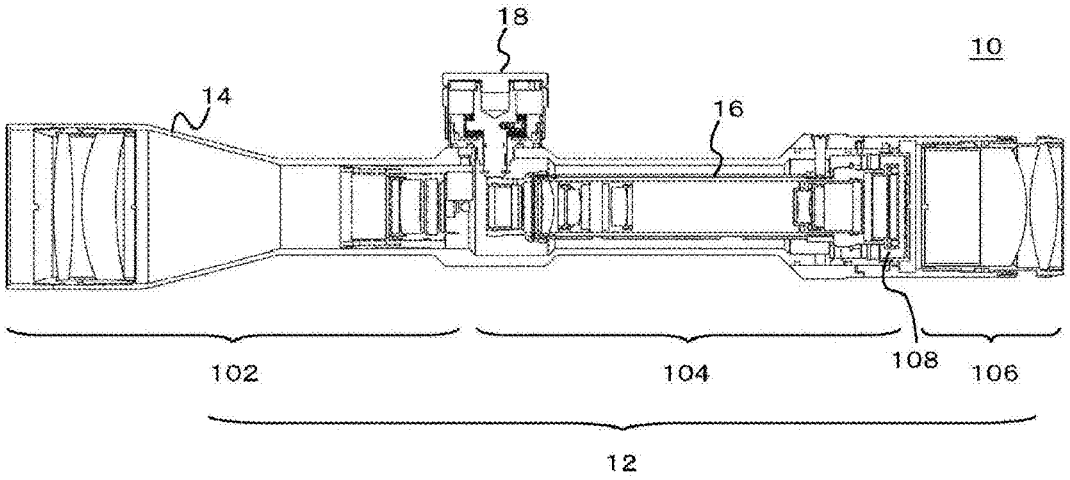
FIG. 1A to FIG. 1C are diagrams describing an optical sight 10 according to an embodiment of the disclosure.

Regarding the optical sight, in order to obtain the information for adjusting the impact position or the like without taking the target out of view, it is conceivable to, for example, attach an additional part (additional hardware) for information confirmation to the outside of an eyepiece lens of the optical sight. In fact, existing products used as such an additional part are also known. However, in the case of using such a product, by using additional hardware other than the optical sight, for example, a total weight of members related to the optical sight is significantly increased. As a result, it is conceivable that, for example, the luggage carried by a user during use of the gun may be increased in weight, or handling of the gun may become difficult. In this case, by using such additional hardware, it is also conceivable that, for example, necessary costs associated with the optical sight are significantly increased. More specifically, for example, compared to using only a general optical sight, about twice the amount of the costs may be required in this case. In this case, due to the effects of the additional hardware, for example, members attached to the gun may be increased in size, and the appearance of the gun may deteriorate. Furthermore, in this case, by attaching other members to the outside of the eyepiece lens, for example, the amount of light reaching the user from the target may decrease and the target may become difficult to see. Particularly, in environments with weak sunlight such as at dusk, it is conceivable that the target becomes difficult to visually recognize.

With respect to this, the present inventor conceived of installing an information display device (information display part) within a housing that accommodates an optical system of the optical sight, and displaying information around a field of view that the optical system allows the user to perform visual recognition. With such a configuration, for example, while an increase in size or weight of the optical sight can be appropriately suppressed, the information can be appropriately displayed to the user. In this case, by displaying information around the field of view, for example, while the influence on visibility of the target can be reduced, the information can be relatively appropriately displayed to the user. Through further intensive research, the present inventor discovered the features necessary to obtain such effects, leading to the disclosure. To solve the above problems, the disclosure provides an optical sight that is attached to a gun for use, characterized by including: an optical system, allowing a user to visually recognize a target serving as a sight target; a housing, accommodating the optical system; and an information display part, displaying information toward the user. The information display part is installed within the housing together with the optical system, so as to display the information around a field of view that the optical system allows the user to perform visual recognition.

With such a configuration, for example, while an increase in size or weight of the optical sight can be appropriately suppressed, the information can be appropriately displayed to the user. Accordingly, for example, a significant increase in the total weight of members related to the optical sight or a deterioration in the appearance of the gun, can be appropriately prevented. In this case, by accommodating the information display part within the housing of the optical sight, the necessary costs associated with the optical sight can be significantly reduced compared to, for example, the case where additional hardware is attached to the optical sight. Furthermore, in this case, by displaying information around the field of view, for example, while the influence on visibility of the target can be reduced, the information can be relatively appropriately displayed to the user. In this case, since there is no need to attach other members between the optical sight and the user, for example, a decrease in the amount of light reaching the user from the target can also be appropriately prevented. Hence, with such a configuration, for example, information can be relatively appropriately displayed to the user in the optical sight.

In this configuration, the optical system includes, for example: an objective system, forming an inverted image of the target on a first focal plane; an erecting system, forming an erect image obtained by inverting the inverted image on a second focal plane; and an eyepiece system, allowing the user to visually recognize the erect image formed on the second focal plane. In this case, the information display part displays information in such a way that, for example, the information is visually recognized by the user via at least a portion of the eyepiece system and without via the objective system. With such a configuration, for example, the information can be appropriately displayed to the user using the information display part arranged within the housing. In this configuration, the optical system may further include a viewing ring (field stop) that defines a range of the field of view in which the user performs visual recognition. In this case, displaying information around the field of view can be considered as, for example, displaying information around the field of view defined by the viewing ring. More specifically, in this case, the viewing ring includes, for example, a frame surrounding a field of view corresponding hole being a through hole defining the range of the field of view. The information display part displays the information in such a way that, for example, in a state in which the field of view corresponding to the entire field of view corresponding hole in the viewing ring is visually recognized by the user, the information is shown around the field of view. With such a configuration, for example, information can be appropriately displayed around the field of view that includes the target. Showing information around the field of view in the state in which the field of view corresponding to the entire field of view corresponding hole in the viewing ring is visually recognized by the user can be considered as, for example, displaying information in a manner not overlapping the field of view.

In the case where the optical system includes the viewing ring, it is conceivable to attach the information display part to, for example, the frame of the viewing ring. With such a configuration, for example, the information display part can be appropriately installed within the housing of the optical sight. In this case, for example, by attaching the information display part to the frame of the viewing ring, information can be appropriately displayed around the field of view of the optical sight. More specifically, the viewing ring is generally arranged at a position close to a focal plane (for example, second focal plane) in the optical system. In this case, by installing the information display part at the position of the viewing ring, for example, the information displayed by the information display part can be appropriately visually recognized by the user without significantly changing the user's eye focus or line of sight direction or the like that has been matched with the target. Hence, with such a configuration, for example, it can be relatively appropriately prevented that the user loses sight of the target while confirming the information. In the case of attaching the information display part to the frame of the viewing ring, it is conceivable to attach the information display part to, for example, a surface on an eyepiece side (near side with respect to the user) of the frame. With such a configuration, for example, the information display part can be easily and appropriately attached to the viewing ring. It is also conceivable to attach the information display part to, for example, a surface on an objective side (far side with respect to the user) of the frame of the viewing ring. In this case, it is conceivable to form, in the frame, a frame through hole being a through hole separate from the field of view corresponding hole. In this case, the information display part displays the information in such a way that, for example, the information is visually recognized by the user via the frame through hole. Even with such a configuration, for example, the information can be appropriately displayed to the user. The information display part may be installed, for example, at a position different from the viewing ring. In this case, it is preferable that the optical sight further includes, for example, a frame-like member to which the information display part is attached. In this case, it is conceivable to arrange the information display part at, for example, a position closer to the eyepiece side than the viewing ring. By forming the frame through hole in the frame of the viewing ring, it is also conceivable to arrange the information display part at, for example, a position closer to the objective side than the viewing ring.

In this configuration, for example, it is preferable that the information displayed by the information display part can be visually recognized by the user as needed. More specifically, in the optical sight, for example, depending on the situation, it is sometimes preferable to make the field of view relatively large for the user to perform visual recognition, without allowing the user to visually recognize information displayed around the field of view. In this case, for example, it is conceivable that the user changes the position of their eye in an optical axis direction of the optical sight to thereby change between a state in which information is visually recognized around the field of view and a state in which at least a portion of the information is hidden. More specifically, in this case, it is conceivable to display information by the information display part in such a way that, for example, the state changes from a state in which the user performs visual recognition in the field of view with the information hidden to a state in which the information is visually recognized around the field of view as the user brings their eye closer to the optical sight. Such a configuration can be considered as, for example, the following configuration. That is, in the case where the user performs visual recognition in the field of view of the optical sight from at least some positions in a range of an eye relief corresponding to the optical system of the optical sight, at least a portion of the information displayed by the information display part is hidden; in the case where the user performs visual recognition in the field of view of the optical sight from a position closer than the at least some positions, the entire information displayed by the information display part is visually recognized by the user.

In this configuration, the optical sight may further include a display control part that controls the information display part to display information. With such a configuration, for example, an operation of the information display part can be appropriately controlled. The display control part, for example, causes the information display part to display information based on information detected by various sensors. The display control part may cause externally acquired information to be displayed as at least a portion of the information displayed by the information display part, the externally acquired information being information acquired from a device external to the optical sight. As the externally acquired information, it is conceivable to use, for example, at least one of wind speed, wind direction, and distance. In this case, the distance can be considered as, for example, a distance from the optical sight to the target. With such a configuration, for example, various information can be appropriately displayed by the information display part. As the external device, for example, a portable information device such as a smartphone, can be suitably used. As a configuration of the disclosure, it is also conceivable to use, for example, an information display method having similar features to those described above. In this case as well, for example, similar effects to those described above can be obtained.

According to the disclosure, for example, in the optical sight, information can be relatively appropriately displayed to the user.

Figure 1B:
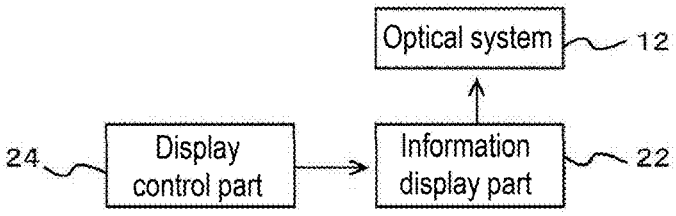
Figure 1C:
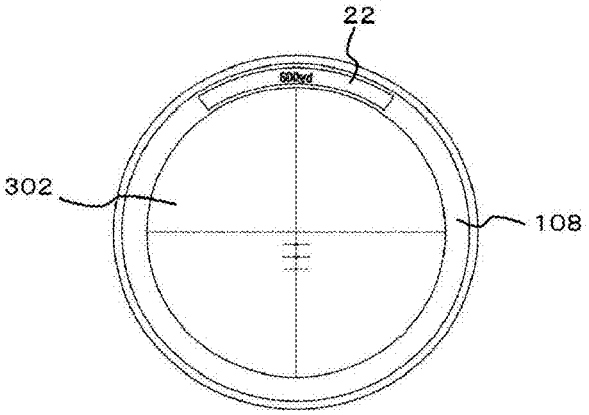

An embodiment according to the disclosure is hereinafter described with reference to the drawings. FIG. 1A to FIG. 1C are diagrams describing an optical sight 10 according to an embodiment of the disclosure. FIG. 1A is a cross-sectional view showing an example of a configuration of main parts of the optical sight 10. FIG. 1B is a block diagram schematically showing functions of some components in the optical sight 10. The optical sight 10 is an optical device that allows a user to visually recognize a target (object), and is attached to a gun such as a hunting rifle or a sport pistol for use. In this case, the user is, for example, a hunter or shooter who uses the gun to which the optical sight 10 is attached. In the present example, the optical sight 10 is attached to a gun (for example, a rifle) for long-distance shooting, enlarging a view of a target in the distance, such as hunting game or a shooting target, and allowing the user to visually recognize the target. In this case, the optical sight 10 can be considered as, for example, a telescopic sight having a telescopic function. The optical sight 10 can also be considered as a scope (for example, a rifle scope) attached to the gun. In the present example, as shown with reference numerals in FIG. 1A, the optical sight 10 includes an optical system 12, a housing 14, a movable cylinder 16, and an adjustment mechanism 18. In addition to the configurations marked with reference numerals in FIG. 1A, the optical sight 10 further includes an information display part 22 and a display control part 24, as shown in FIG. 1B. Except for the points described below, the optical sight 10 and each part thereof may have the same or similar features as those of a known optical sight and each part thereof. For example, except for the points described below, as a configuration of each part of the optical sight 10, a configuration having the same functions as those of a known configuration, can be suitably used.

In the present example, the optical system 12 includes an objective system 102, an erecting system 104, an eyepiece system 106, and a viewing ring 108. The objective system 102, which is on an objective side (objective lens side; far side with respect to the user), is arranged facing the front side of the gun. The eyepiece system 106, which is on an eyepiece side (eyepiece lens side; near side with respect to the user), is arranged facing the rear side of the gun. Thereby, the user, who is the shooter of the gun, is allowed to visually recognize the target serving as a sight target. In this case, the target can be considered as, for example, an object to be shot by the gun. The objective system 102 is a portion constituting a side (objective side) closer to the target than the erecting system 104 in the optical system 12, and forms an inverted image of the target on the first focal plane (first focal plane). The objective system 102 can also be considered as, for example, an objective optical system constituting a portion of the optical system 12. The first focal plane can be considered as, for example, a focal plane set at a predetermined first position in an optical axis direction of the optical sight 10. In the illustrated configuration, the objective system 102 includes multiple lenses. In this case, the multiple lenses in the objective system 102 can be considered as, for example, objective lenses of the optical sight 10.

The erecting system 104 is a portion that forms an erect image corresponding to the aforementioned inverted image between the objective system 102 and the eyepiece system 106 in the optical system 12, and forms, on the second focal plane, an erect image obtained by inverting the inverted image formed on the first focal plane. The erecting system 104 can also be considered as, for example, an erecting optical system constituting a portion of the optical system 12. The second focal plane can be considered as, for example, a focal plane set at a predetermined second position in the optical axis direction of the optical sight 10. In the present example, the erecting system 104 includes multiple lenses. These multiple lenses are arranged between the first focal plane and the second focal plane, and form, on the second focal plane, the erect image obtained by inverting the inverted image formed on the first focal plane. In the present example, the erecting system 104 changes a magnification of the optical sight 10 by, for example, moving at least some of the multiple lenses in an axial direction of the movable cylinder 16. In this case, the erecting system 104 changes the magnification, for example, in accordance with the user's operation of adjusting the magnification of the optical sight 10. In this case, the multiple lenses in the erecting system 104 can be considered as, for example, a lens group that inverts the inverted image formed on the first focal plane into the erect image and adjusts the magnification.

The eyepiece system 106 is a portion constituting a side (eyepiece side) closer to the user than the erecting system 104 in the optical system 12, and allows the user to visually recognize the erect image formed on the second focal plane. The eyepiece system 106 can also be considered as, for example, an eyepiece optical system constituting a portion of the optical system 12. In the present example, the eyepiece system 106 includes multiple lenses. The multiple lenses in the eyepiece system 106 can be considered as, for example, eyepiece lenses of the optical sight 10. The viewing ring 108 is an annular member (field stop) that defines a range of a field of view in which the user performs visual recognition, and is arranged, for example, between the erecting system 104 and the eyepiece system 106. In this case, the viewing ring 108 can be considered to be installed at a position close to a focal plane in the optical system 12. In the present example, the viewing ring 108 can be considered to be arranged, for example, in the vicinity of the second focal plane. Depending on how a configuration in the optical system 12 is classified, the viewing ring 108 can also be considered as, for example, a configuration included in the erecting system 104. The viewing ring 108 can also be considered as, for example, a configuration included in the eyepiece system 106. A configuration of the viewing ring 108 will be described in more detail later.

The housing 14 is a configuration that accommodates each part of the optical sight 10, and is fixedly attached to a predetermined position on the gun using, for example, a mount omitted from illustration. In this case, the housing 14 can be considered to accommodate, for example, at least the optical system 12. In the present example, the housing 14 further accommodates, for example, at least a portion of the adjustment mechanism 18, and the information display part 22 and the display control part 24. In this case, the information display part 22 and the display control part 24 or the like can also be considered to be, for example, arranged inside the optical sight 10. The movable cylinder 16 is a cylindrical body that holds multiple lenses in the erecting system 104, and is arranged within the housing 14 so that its axial direction changes according to user operation with respect to the adjustment mechanism 18. More specifically, the movable cylinder 16, for example, changes its axial inclination by moving an end on the objective system 102 side in an up-down direction and a left-right direction, with a predetermined position on the eyepiece system 106 side as a fulcrum. In this case, the movable cylinder 16 can be considered to have, for example, a structure that tilts inside a main body of the optical sight 10, with an end on the eyepiece system 106 side or the like as a fulcrum. The up-down direction and left-right direction can be considered as, for example, the up-down direction and left-right direction during use of the optical sight 10 attached to the gun. In FIG. 1A, the up-down direction in the figure corresponds to the up-down direction of the optical sight 10. A direction orthogonal to the paper surface and the up-down direction in the figure corresponds to the left-right direction of the optical sight 10.

The adjustment mechanism 18 is a mechanism that makes adjustments related to functions of the optical sight 10 according to user operation. Making adjustments related to functions of the optical sight 10 can be considered as, for example, adjusting optical characteristics or sight of the optical sight 10. The adjustment mechanism 18 can also be considered as, for example, a configuration that provides a correction function to the optical sight 10. More specifically, in the present example, the adjustment mechanism 18 is a mechanism that adjusts at least an impact position, and adjusts the optical sight 10 by adjusting the inclination of the axial direction of the movable cylinder 16 according to user operation. Adjusting the impact position can be considered as, for example, adjusting a relationship between a point of impact (impact position) of a bullet fired from the gun to which the optical sight 10 is attached and the optical axis direction of the optical sight 10. Adjusting the impact position can also be considered as, for example, adjusting the sighting for aligning an aiming point of the gun with the point of impact. Adjusting the sighting can be considered as, for example, adjusting the optical sight 10 in accordance with an expected trajectory. In the present example, by inclining the axial direction of the movable cylinder 16, the adjustment mechanism 18, for example, changes the center of an image to be visually recognized by the user, and adjusts the point of impact. In FIG. 1A, for the ease of illustration, regarding the adjustment mechanism 18, only the configuration for adjusting the impact position in the up-down direction is mainly shown. The adjustment mechanism 18 further includes, in addition to the shown configuration, a configuration for adjusting the impact position in the left-right direction. The adjustment mechanism 18 may further include mechanisms for other adjustments than that for the impact position. For example, the adjustment mechanism 18 may further include a mechanism for changing the magnification of the optical sight 10. The optical sight 10 may include a mechanism for changing the magnification of the optical sight 10 separately from the adjustment mechanism 18 for adjusting the impact position.

As described above, in the present example, the optical sight 10 further includes the information display part 22 and the display control part 24, in addition to the configurations marked with reference numerals in FIG. 1A. In the present example, the information display part 22 is a display device that displays information to the user. The information display part 22 performs display in a display form using, for example, numbers, alphabets, and symbols. As the information display part 22, for example, a known display device that performs display in a digital form, can be suitably used. More specifically, as the information display part 22, for example, a display device using an LED or an organic EL display (OLED), can be suitably used. In the present example, the information display part 22 is installed within the housing 14 together with the optical system 12, thereby displaying information around a field of view 302 defined by the viewing ring 108 inside the optical sight 10, as shown in, for example, FIG. 1C. FIG. 1C shows an example of how information is displayed by the information display part 22. In this case, the field of view 302 defined by the viewing ring 108 can be considered as, for example, a field of view that the optical system 12 of the optical sight 10 allows the user to perform visual recognition. The field of view 302 can also be considered as, for example, a field of view showing the scenery outside the optical sight 10. Displaying information around the field of view 302 can also be considered as, for example, displaying information on an edge portion within a tube of the optical sight 10. In the optical sight 10, it is conceivable to display a reticle in the field of view 302 using, for example, a known method. In this case, it can be considered to display information around the field of view 302, for example, to display information on the edge within the tube without overlapping or interfering with the reticle displayed in the field of view 302. In this case, regarding how information is displayed by the information display part 22, for example, it can also be considered to display information in such a way that the entire field of view 302 in a circular shape defined by the viewing ring 108 is visible without any portion of the field of view 302 being covered by the information.

As the information display part 22, for example, a self-luminous type display device can be conceivably used. The self-luminous type display device can be considered as, for example, a device that displays, by expressing through light emission, characters or numbers indicating information. The self-luminous type display device can also be considered as, for example, a device that displays information without using a separate lighting device such as a backlight. By using the information display part 22 like this, for example, the display of information by the information display part 22 installed within the housing 14 can be relatively appropriately performed. In this case, for example, by lighting only a minimum necessary area for displaying information, the influence on the visibility of an object in the field of view 302 can be relatively appropriately reduced compared to, for example, the case of using a display device that uses a backlight. An example of a position where the information display part 22 is installed within the housing 14 will be described in more detail later.

The display control part 24 is a controller that controls the information display part 22 to display information. As the display control part 24, for example, a microcomputer, can be suitably used. The display control part 24 is, for example, installed at a position within the housing 14 that does not affect an optical path of the optical sight 10, thereby controlling an operation of the information display part 22 within the optical sight 10. The display control part 24 causes the information display part 22 to display information based on, for example, information detected by various sensors. In this case, as the sensors, for example, a sensor attached to the optical sight 10 or a sensor external to the optical sight 10, may be used. As the sensor external to the optical sight 10, for example, a sensor attached to the gun together with the optical sight 10, can be conceivably used. As the sensor external to the optical sight 10, for example, a sensor that is neither attached to the optical sight 10 nor attached to the gun, may be used. In the case where the sensor external to the optical sight 10 is used, the display control part 24 may acquire information detected by the sensor from, for example, a device external to the optical sight 10. More specifically, in the present example, the display control part 24 displays, as at least a portion of the information displayed by the information display part 22, externally acquired information, which is information acquired from the device external to the optical sight 10. In this case, as the externally acquired information, for example, at least one of wind speed, wind direction, and distance, can be considered. The distance can be considered as, for example, a distance from the optical sight 10 to the target. With such a configuration, for example, various information can be appropriately displayed by the information display part 22. As the external device, for example, a portable information device such as a smartphone, can be suitably used. In this case, the information display part 22 acquires information from the portable information device by, for example, connecting to the portable information device by a method such as Bluetooth connection. The information display part 22 may acquire, from the portable information device, for example, information other than the information detected by a sensor, as the externally acquired information. In this case, as the externally acquired information, for example, information acquired by a portable information terminal via the Internet, can be considered.

As described above, the display control part 24 may cause the information display part 22 to display information based on information detected by a sensor attached to the optical sight 10. In this case, the display control part 24 may detect, for example, wind speed, wind direction, and distance, based on an output from the sensor attached to the optical sight 10. FIG. 1C illustrates an example of a state in which a distance to the target is displayed, as an example of how information is displayed by the information display part 22. The information display part 22 displays wind speed, wind direction, and distance by, for example, switching at regular time intervals. The information display part 22 may switch the display of wind speed, wind direction, and distance, for example, according to user operation. In a modification of how information is displayed by the information display part 22, the information display part 22 may, for example, simultaneously display wind speed, wind direction, and distance. Since these kinds of information are displayed around the field of view 302, the user can, for example, appropriately perform an operation (such as dial adjustment) on the adjustment mechanism 18 while confirming various information, without taking their eyes off the target. Accordingly, for example, the impact position can be relatively appropriately adjusted.

In the present example, by installing the information display part 22 within the housing 14 of the optical sight 10, information can be appropriately displayed to the user while, for example, an increase in size or weight of the optical sight 10 can be appropriately suppressed. Accordingly, for example, a significant increase in a total weight of members related to the optical sight 10 or a deterioration in the appearance of the gun, can be appropriately prevented. Compared to the case of, for example, displaying information by attaching additional hardware to the optical sight 10, in this case, necessary costs associated with the optical sight 10 can be significantly reduced. Furthermore, in this case, by displaying information around the field of view 302 in the optical sight 10, information can be appropriately displayed to the user while, for example, the influence on the visibility of the target can be reduced. In the present example, an area around the field of view 302, where the information display part 22 displays information, can be considered to correspond to, for example, an area that exists even in an optical sight having a conventional configuration. Hence, in this respect, it can be said that the configuration of the present example can appropriately prevent an increase in size of the optical sight 10 or the like. Regarding this respect, for example, in the case of displaying information in a manner overlapping the field of view 302, it is necessary to use a transparent display device. In contrast, in the present example, by displaying information around the field of view 302, it is possible to use, for example, an opaque display device, as the information display part 22. Hence, according to the present example, it is possible to use, for example, a less expensive display device, as the information display part 22. Furthermore, in this case, since there is no need to add a member outside the eyepiece system 106 or the like, for example, a decrease in the amount of light reaching the user from the target can be appropriately prevented. Accordingly, for example, it can be appropriately prevented that the transmittance of the optical sight 10 is reduced and the target becomes difficult to see. Hence, according to the present example, while functional degradation that may occur in the case of attaching additional hardware, for example, can be appropriately prevented, in the optical sight 10, information can be relatively appropriately displayed to the user.

The display control part 24 may cause the information display part 22 to display information other than wind speed, wind direction, and distance. In this case, it is preferable that the display control part 24 causes the information display part 22 to further display the other information in addition to at least one of wind speed, wind direction, and distance. More specifically, in this case, the display control part 24 causes the information display part 22 to display, for example, information indicating the inclination of the optical sight 10. The inclination of the optical sight 10 can be considered to correspond to, for example, the inclination of the gun to which the optical sight 10 is attached. The display control part 24 detects the inclination of the optical sight 10 based on, for example, an output from a sensor such as a gyro sensor attached to the optical sight 10 or the gun. In this case, the display control part 24 detects, for example, the inclination in the left-right direction as the inclination of the optical sight 10. The inclination in the left-right direction can be considered as, for example, the inclination in a rotational direction with the optical axis direction of the optical sight 10 as an axis of rotation. Regarding information other than the above, the display control part 24 may cause the information display part 22 to display, for example, at least one of temperature and atmospheric pressure. The display control part 24 may cause the information display part 22 to display, for example, the type (bullet type) of the bullet used in the gun to which the optical sight 10 is attached. By causing the information display part 22 to display these kinds of information, for example, various information can be appropriately shown to the user.

Here, a position where the information display part 22 displays information around the field of view 302 is not limited to the position shown in FIG. 1C, and various modifications are possible. The information display part 22 may show information not only in characters or numbers but also in various graphical representations. For example, the information display part 22 may display an image indicating the inclination as the information indicating the inclination of the optical sight 10, according to the control by the display control part 24. In the present example, the information that the display control part 24 causes the information display part 22 to display can be considered as, for example, peripheral information that affects a trajectory of the gun to which the optical sight 10 is attached. In this case, by displaying information by the information display part 22 installed within the optical sight 10, it can also be considered that it is possible to appropriately adjust the optical sight 10 while, for example, confirming the peripheral information according to information seen through the optical sight 10. Regarding the optical sight 10 of the present example, it can also be considered as a configuration enabling appropriate adjustment to the optical sight 10 utilizing the peripheral information while, for example, aiming at a target such as hunting game or a shooting target with the optical sight 10.

As described above, as an adjustment to the optical sight 10, it is conceivable to, for example, adjust the impact position. As an adjustment to the optical sight 10, it is also conceivable to, for example, adjust a focus in the optical system 12 of the optical sight 10. Furthermore, it is also conceivable to, for example, adjust the gun based on the information shown by the information display part 22. In this case, it is conceivable to, for example, move the gun based on information indicating the inclination of the optical sight 10 to thereby adjust an angle of the gun. Regarding this respect, in a shooting operation using the gun, in order to correctly land a bullet, it is generally preferable to suppress falling of the gun in the left-right direction and keep the gun horizontal (horizontal with respect to an axis of a gun barrel). In this case, the above adjustment is preferably performed, for example, as follows. That is, after the inclination of the gun is confirmed, the user firmly presses the gun against their cheek or the like and fixes their body and the gun, and the above adjustment is performed while the user remains fixed in posture. In contrast, according to the present example, for example, while remaining fixed in posture, the user can confirm various information, and, based on that information, appropriately adjust the optical sight 10. Accordingly, it is possible to relatively accurately aim at the target in, for example, hunting or shooting.

Figure 2A:
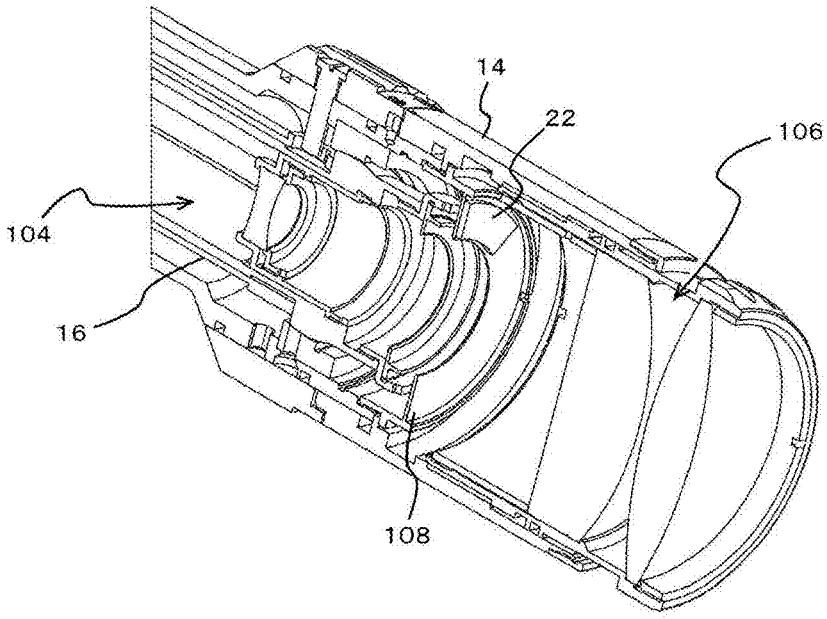
FIG. 2A to FIG. 2C are diagrams showing an example of how the information display part 22 is installed.
Figure 2B:
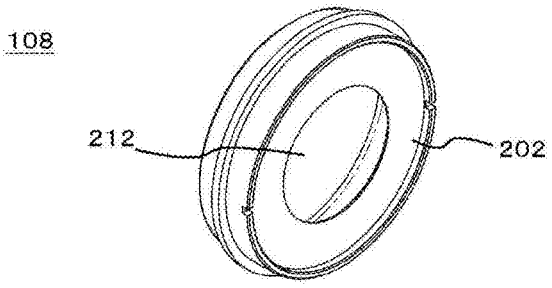
Figure 2C:
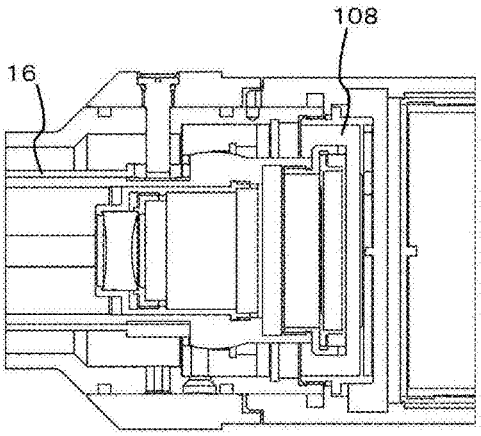
Figure 3A:
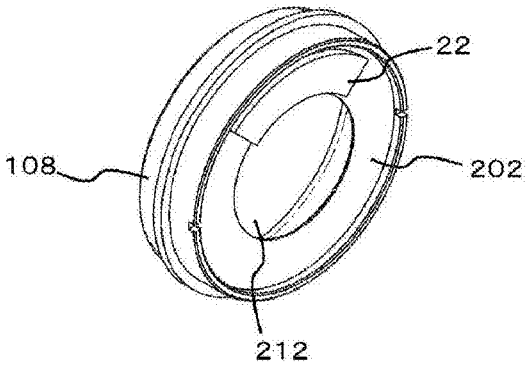
FIG. 3A and FIG. 3B are diagrams showing an example of how the information display part 22 is installed.

As described above, in the present example, the field of view 302 of the optical sight 10 is defined by the viewing ring 108. In this case, as shown in FIG. 2A to FIG. 2C and FIG. 3A to FIG. 3B, for example, it is conceivable to attach the information display part 22 to the viewing ring 108. FIG. 2A to FIG. 2C and FIG. 3A to FIG. 3B show an example of how the information display part 22 is installed. FIG. 2A is a cross-sectional perspective view showing an example of how the information display part 22 is installed on the viewing ring 108, in which a peripheral part of the viewing ring 108 in the optical sight 10 is enlarged. FIG. 2B shows an example of the configuration of the viewing ring 108. FIG. 2C is an enlarged cross-sectional view showing the peripheral part of the viewing ring 108 in the optical sight 10. FIG. 3A is a perspective view showing the viewing ring 108 and the information display part 22 shown in FIG. 2A.

As shown in FIG. 2A and FIG. 3A, in the present example, the information display part 22 is attached to a surface on the eyepiece side of the viewing ring 108. More specifically, in the present example, the viewing ring 108 includes, as shown in FIG. 2B for example, a frame 202 surrounding a field of view corresponding hole 212, the field of view corresponding hole 212 being a through hole defining a range of the field of view. In the example shown in FIG. 2A and FIG. 3A, the information display part 22 is attached to the frame 202 of the viewing ring 108 on the eyepiece side. With such a configuration, for example, the information display part 22 can be easily and appropriately attached to the viewing ring 108. Accordingly, for example, the information display part 22 can be appropriately installed within the housing 14 of the optical sight 10. In this case, by attaching the information display part 22 into the frame 202 of the viewing ring 108, for example, information can be appropriately displayed around the field of view in which the user visually recognizes an object in the optical sight 10. Regarding appropriately displaying information around the field of view, considering in association with functions of the viewing ring 108, it can also be considered that the information display part 22, for example, displays information in such a way that, in a state in which a field of view corresponding to the entire field of view corresponding hole 212 in the viewing ring 108 is visually recognized by the user, the information is shown around the field of view. With such a configuration, the information can be appropriately displayed by the information display part 22 in a manner not overlapping the field of view defined by the viewing ring 108.

As can be understood from the configurations shown in FIG. 2A and FIG. 2C, it can be considered that the information display part 22, for example, displays information in such a way that the information is visually recognized by the user via at least a portion of the eyepiece system 106 and without via the objective system 102 (see FIG. 1). Regarding visual recognition of information by the user via at least a portion of the eyepiece system 106, it can be considered, for example, that the information is visually recognized by the user at least via a lens located closest to the user in the eyepiece system 106. More specifically, in the present example, the information display part 22 displays information in such a way that the information is visually recognized by the user without via a lens in the objective system 102 and the erecting system 104, and via all the lenses in the eyepiece system 106. With such a configuration, for example, information can be appropriately displayed to the user using the information display part 22 arranged within the housing 14.

As described above, in the present example, the viewing ring 108 is arranged between the erecting system 104 and the eyepiece system 106, thereby being installed at a position close to the second focal plane in the optical system 12 (see FIG. 1). In this case, by installing the information display part 22 at the position of the viewing ring 108, for example, the information displayed by the information display part 22 can be appropriately visually recognized by the user without significantly changing the user's eye focus or line of sight direction or the like that has been matched with the target. Hence, according to the present example, for example, it can be relatively appropriately prevented that the user loses sight of the target while confirming the information displayed by the information display part 22. In the optical sight 10, the visibility of the frame 202 of the viewing ring 108 generally changes according to the position of the user's eye. For example, in the case where the user moves their eye back and forth in the optical axis direction of the optical sight 10, regarding the visibility of the frame 202 of the viewing ring 108, generally, by bringing their eye closer to the optical sight 10, the user performs visual recognition in a relatively large range in the frame 202, and by moving their eye away from the optical sight 10, the user performs visual recognition in a relatively small range in the frame 202. In this case, the visibility of the information display part 22 attached to the frame 202 also changes according to the position of the user's eye. In this case, for example, it can be considered that at least a portion of the information display part 22 is hidden in the case where the position of the user's eye is within a predetermined range, and the entire information display part 22 may be visually recognized in the case where the position of the user's eye is within another predetermined range. Hence, according to the present example, for example, the information displayed by the information display part 22 can be made visually recognizable to the user as needed by changing the position of the eye. More specifically, in the optical sight 10, for example, depending on the situation, it is sometimes preferable to make the field of view relatively large for the user to perform visual recognition, without allowing the user to visually recognize information displayed around the field of view. In this case, for example, it is conceivable that the user changes the position of their eye in the optical axis direction of the optical sight 10 to thereby change between a state in which information is visually recognized around the field of view and a state in which at least a portion of the information is hidden. In this case, regarding the way of displaying information by the information display part 22 realized by installing the information display part 22 at a predetermined position, for example, it can also be considered that the information is displayed in such a way that the user brings their eye closer to the optical sight 10 to thereby change from a state in which the user performs visual recognition in the field of view with the information hidden to a state in which the information is visually recognized around the field of view.

The visibility of information like this can also be considered, for example, by focusing on a relationship with an eye relief corresponding to the optical system 12 of the optical sight 10. In this case, the eye relief can be considered as, for example, a distance from a final lens surface (final surface; rear end surface) of the eyepiece system 106 to an eyepoint. The eyepoint can be considered as, for example, a position of the eye where it is possible to look around the entire apparent field of view in the optical system 12. The eyepoint can also be considered as, for example, a position where the pupil can be formed in the optical system 12. The eye relief can also be considered as, for example, a distance from an eyepiece lens to the eyepoint in a state in which the field of view of the optical sight 10 can be clearly seen. The eye relief can also be considered as, for example, a range of positions at which the user should place their eye when shooting with the gun to which the optical sight 10 is attached. The eye relief can also be considered as, for example, a position where the field of view appears clearly as a perfect circle at magnification setting determined by oneself when the user looks through the optical sight 10 from the final surface of the eyepiece system 106. In the optical sight 10, the eye relief may be, for example, an eye relief according to the specifications of the optical sight 10. As the eye relief, it is generally conceivable to use values in a wide range to some extent, such as, for example, 90 mm to 100 mm.

In this case, regarding a relationship between the visibility of the information display part 22 and the position of the user's eye, for example, the following relationship can be considered. That is, in the case where the user performs visual recognition in the field of view of the optical sight 10 from at least some of the positions within the eye relief range, at least a portion of the information displayed by the information display part 22 is hidden; in the case where the user performs visual recognition in the field of view of the optical sight 10 from a position closer than the at least some of the positions, the entire information displayed by the information display part 22 is visually recognized by the user. More specifically, in the case where the eye relief has a wide range as mentioned above, for example, in the case where the user performs visual recognition in the field of view of the optical sight 10 from a position in a portion on a long distance side in the eye relief range or in the entire eye relief range, it is conceivable that at least a portion of the information displayed by the information display part 22 is hidden. The long distance side in the eye relief range can be considered as, for example, a side further away from the final surface of the eyepiece system 106 in the optical system 12. In this case, for example, as the user brings their eye closer to the optical sight 10 from this state, the entire information displayed by the information display part 22 is visually recognized by the user. With such a configuration, for example, the visibility of the information display part 22 can be appropriately changed according to the position of the user's eye. In this case, it can also be considered that the entire information displayed by the information display part 22, for example, is visually recognized by the user by performing visual recognition in the field of view from a position closer than the eye relief or from a short distance side of the eye relief.

In the case where the entire information displayed by the information display part 22 is configured to be visually recognized by the user by moving their eye to the position closer than the eye relief, regarding the visibility of the information display part 22, the following can also be considered. That is, for example, in a normal state in which the sight of the gun to which the optical sight 10 is attached is aligned with the target, at least a portion of the information display part 22 is hidden; as the user brings their eye closer to the optical sight 10, the entire information display part 22 becomes visible. With such a configuration, for example, without narrowing the field of view during the execution of shooting with the gun, the information shown by the information display part 22 can be appropriately visually recognized by the user as needed. In this case, it is conceivable that, for example, the entire information display part 22 may be hidden and become invisible in at least a portion on the long distance side in the eye relief range. With such a configuration, for example, during execution of shooting, the user can relatively concentrate on the field of view.

As described above, the information displayed by the information display part 22 may be visually recognized by the user within the eye relief range. In this case, for example, it is conceivable that the entire information display part 22 is visually recognized by the user in at least a portion on the short distance side in the eye relief range. With such a configuration, for example, while the user is allowed to visually recognize the target within the field of view in a clear state, the user is further allowed to visually recognize the information shown by the information display part 22. According to performance required for the optical sight 10 or the like, for example, it is also conceivable that the user visually recognizes the information displayed by the information display part 22 in the entire eye relief range. With such a configuration, for example, an adjustment to the adjustment mechanism 18 can always be relatively appropriately made while the information display part 22 is confirmed in the same state as during the execution of shooting. Accordingly, the adjustment mechanism 18 can be adjusted with relatively high precision. Such a configuration can be considered as, for example, a configuration in which the information shown by the information display part 22 is visible around the field of view in the normal state in which the user performs visual recognition in the field of view.

Figure 3B:
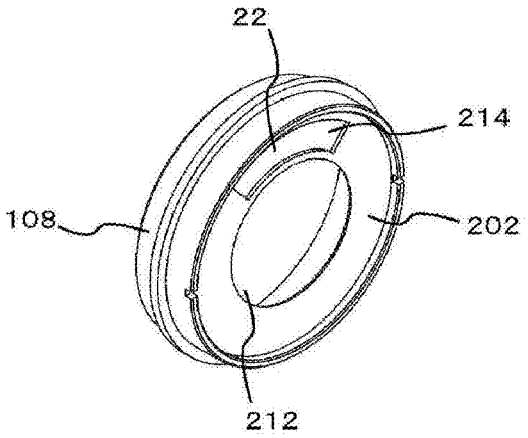

As described above, in the case of the configuration shown in FIG. 2A and FIG. 3A, the information display part 22 is attached to the surface on the eyepiece side of the viewing ring 108. In contrast, in a modification of the configuration of the optical sight 10, the information display part 22 may be attached to other positions. In this case, as shown in FIG. 3B for example, it is also conceivable to attach the information display part 22 to a surface on the objective side of the frame 202 of the viewing ring 108. FIG. 3B shows another example of how the information display part 22 is attached. In this case, for example, a frame through hole 214, which is a through hole separate from the field of view corresponding hole 212, is formed in the frame 202 of the viewing ring 108. Then, the information display part 22 is attached to the surface on the objective side of the frame 202, thereby displaying information in such a way that the information is visually recognized by the user via the frame through hole 214. Even in such a configuration, information can be appropriately displayed to the user.

The information display part 22 may be installed, for example, at a position different from the viewing ring 108. In this case, for example, it is conceivable to install the information display part 22 at a position on the eyepiece side of the viewing ring 108. By forming the frame through hole 214 in the frame 202 of the viewing ring 108, it is also conceivable to install the information display part 22, for example, at a position on the objective side of the viewing ring 108. In these cases, it is preferable that the optical sight 10 further includes, for example, at a position where the information display part 22 is attached, a frame-like member to which the information display part 22 is attached. With such a configuration, for example, the information display part 22 can be appropriately installed at various positions within the housing 14 of the optical sight 10. In these cases as well, the information display part 22, for example, displays information around the field of view of the optical sight 10. By installing the information display part 22 at a predetermined position in the optical axis direction of the optical sight 10, it is conceivable that, for example, the visibility of the information display part 22 may be changed according to the position of the user's eye.

The disclosure can be suitably used for, for example, optical sights.

The invention claimed is:

1. An optical sight that is attached to a gun for use, comprising:

an optical system, allowing a user to visually recognize a target serving as a sight target, wherein the optical system comprises an objective system, an erecting system, an eyepiece system and a viewing ring, the objective system forms an inverted image of the target on a first focal plane, the erecting system forms an erect image obtained by inverting the inverted image on a second focal plane, the eyepiece system allows the user to visually recognize the erect image formed on the second focal plane, and the viewing ring is arranged between the erecting system and the eyepiece system;

a housing, accommodating the optical system; and an information display part, attached to the viewing ring and displaying information toward the user, wherein the information display part is installed within the housing together with the optical system, so as to display the information around a field of view that the optical system allows the user to perform visual recognition, wherein the second focal plane is closer to the information display part than the first focal plane.

2. The optical sight according to claim 1, wherein the information display part displays the information in such a way that the information is visually recognized by the user via at least a portion of the eyepiece system and without via the objective system.

3. The optical sight according to claim 2, wherein the viewing ring defines a range of the field of view in which the user performs visual recognition, the viewing ring comprises a frame surrounding a field of view corresponding hole being a through hole defining the range of the field of view; and the information display part displays the information in such a way that, in a state in which the field of view corresponding to the entire field of view corresponding hole in the viewing ring is visually recognized by the user, the information is shown around the field of view.

4. The optical sight according to claim 3, wherein the information display part is attached to the frame of the viewing ring.

5. The optical sight according to claim 3, wherein a frame through hole being a through hole separate from the field of view corresponding hole is formed in the frame of the viewing ring; and the information display part displays the information in such a way that the information is visually recognized by the user via the frame through hole.

6. The optical sight according to claim 1, further comprising:

a display control part, controlling the information display part to display the information, wherein the display control part causes externally acquired information to be displayed as at least a portion of the information displayed by the information display part, the externally acquired information being information acquired from a device external to the optical sight, and the display control part uses at least one of wind speed, wind direction, and distance as the externally acquired information.

7. An information display method that displays information in an optical sight attached to a gun for use, comprising:

installing an information display part that displays the information toward a user inside a housing that accommodates an optical system that allows the user to visually recognize a target serving as a sight target in the optical sight, wherein the optical system comprises an objective system, an erecting system, an eyepiece system and a viewing ring, the objective system forms an inverted image of the target on a first focal plane, the erecting system forms an erect image obtained by inverting the inverted image on a second focal plane, the eyepiece system allows the user to visually recognize the erect image formed on the second focal plane, the viewing ring is arranged between the erecting system and the eyepiece system, and the information display part is attached to the viewing ring; and by the information display part, causing the information to be displayed around a field of view that the optical system allows the user to perform visual recognition, wherein the second focal plane is closer to the information display part than the first focal plane.

* * * * *